US010283238B1

(12) United States Patent
Shanbhag et al.

(10) Patent No.: US 10,283,238 B1
(45) Date of Patent: May 7, 2019

(54) ELECTRICAL CABLE

(71) Applicant: TE CONNECTIVITY CORPORATION, Berwyn, PA (US)

(72) Inventors: Megha Shanbhag, Santa Clara, CA (US); Chad William Morgan, Carneys Point, NJ (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/925,265

(22) Filed: Mar. 19, 2018

(51) Int. Cl.

| | |
|---|---|
| ***H01B 7/00*** | (2006.01) |
| ***H01B 11/00*** | (2006.01) |
| ***H01R 13/6592*** | (2011.01) |
| ***H01B 11/10*** | (2006.01) |
| ***H01B 7/17*** | (2006.01) |
| *H01B 1/22* | (2006.01) |

(52) U.S. Cl.
CPC ..... *H01B 11/002* (2013.01); *H01B 7/17* (2013.01); *H01B 11/1016* (2013.01); *H01R 13/6592* (2013.01); *H01B 1/22* (2013.01); *H01B 11/1008* (2013.01)

(58) Field of Classification Search
CPC ... H02B 7/02; H02B 7/04; H02B 7/06; H02B 9/02; H02B 9/04; H02B 11/02; H02B 11/04
USPC ..... 174/110 R, 113 R, 117 R, 36, 102 R
See application file for complete search history.

(56) References Cited

U.S. PATENT DOCUMENTS

| | | | | |
|---|---|---|---|---|
| 3,340,353 A | | 9/1967 | Mildner | |
| 3,439,111 A | * | 4/1969 | Miracle | H01B 11/1016 174/107 |
| 4,221,926 A | | 9/1980 | Schneider | |
| 4,596,897 A | | 6/1986 | Grunt | |
| 4,644,092 A | | 2/1987 | Gentry | |
| 5,142,100 A | | 8/1992 | Vaupotic | |
| 5,329,064 A | | 7/1994 | Tash et al. | |
| 5,349,133 A | | 9/1994 | Rogers | |
| 5,619,016 A | * | 4/1997 | Newmoyer | H01B 11/02 174/113 R |

(Continued)

FOREIGN PATENT DOCUMENTS

| | | |
|---|---|---|
| CN | 201327733 | 10/2009 |
| CN | 201359878 | 12/2009 |

(Continued)

OTHER PUBLICATIONS

Co-pending U.S. Appl. No. 15/925,243, filed Mar. 19, 2018.

(Continued)

*Primary Examiner* — William H. Mayo, III

(57) ABSTRACT

An electrical cable includes a conductor assembly having a first conductor, a second conductor, and an insulator structure surrounding the first conductor and the second conductor. The insulator structure has an outer surface. The first and second conductors carry differential signals. A cable shield is wrapped around the conductor assembly and engages the outer surface of the insulator structure. The cable shield has an inner edge and a flap covering the inner edge. The cable shield forms a void at the inner edge being located closer to the first conductor than the second conductor. The first conductor has a first diameter and the second conductor has a second diameter. The first diameter is less than the second diameter.

20 Claims, 2 Drawing Sheets

(56) References Cited

U.S. PATENT DOCUMENTS

| | | | | |
|---|---|---|---|---|
| 6,010,788 | A | 1/2000 | Kebabjian et al. | |
| 6,403,887 | B1 * | 6/2002 | Kebabjian | H01B 11/002 174/110 R |
| 6,504,379 | B1 | 1/2003 | Jackson | |
| 6,677,518 | B2 | 1/2004 | Hirakawa et al. | |
| 7,314,998 | B2 | 1/2008 | Amato et al. | |
| 7,790,981 | B2 | 9/2010 | Vaupotic et al. | |
| 7,827,678 | B2 | 11/2010 | Dion et al. | |
| 7,999,185 | B2 * | 8/2011 | Cases | H01B 11/203 174/113 R |
| 8,378,217 | B2 | 2/2013 | Sugiyama et al. | |
| 8,381,397 | B2 | 2/2013 | Dion et al. | |
| 8,440,910 | B2 * | 5/2013 | Nonen | H01B 11/203 174/113 R |
| 8,546,691 | B2 * | 10/2013 | Watanabe | H01B 11/18 174/102 R |
| 8,552,291 | B2 * | 10/2013 | Lingambudi | H01B 11/203 174/110 R |
| 8,575,488 | B2 | 11/2013 | Sugiyama et al. | |
| 8,674,228 | B2 | 3/2014 | Dion et al. | |
| 8,866,010 | B2 | 10/2014 | Nonen et al. | |
| 8,981,216 | B2 * | 3/2015 | Grant | H01B 11/06 174/113 R |
| 8,993,883 | B2 | 3/2015 | Kumakura et al. | |
| 9,064,621 | B2 | 6/2015 | Kodama et al. | |
| 9,117,572 | B2 | 8/2015 | Fukasaku | |
| 9,123,452 | B2 | 9/2015 | Sugiyama et al. | |
| 9,123,457 | B2 | 9/2015 | Kaga et al. | |
| 9,136,042 | B2 * | 9/2015 | Sugiyama | H01B 11/00 |
| 9,142,333 | B2 * | 9/2015 | Kaga | H01B 13/142 |
| 9,159,472 | B2 | 10/2015 | Nordin et al. | |
| 9,214,260 | B2 | 12/2015 | Ishikawa et al. | |
| 9,299,481 | B2 * | 3/2016 | Ishikawa | H01B 11/002 |
| 9,349,508 | B2 * | 5/2016 | Nonen | H01B 11/20 |
| 9,350,571 | B2 | 5/2016 | Watanabe et al. | |
| 9,466,408 | B2 | 10/2016 | Sugiyama | |
| 9,484,127 | B2 | 11/2016 | Sugiyama et al. | |
| 9,496,071 | B2 | 11/2016 | Nagagashi | |
| 9,548,143 | B2 | 1/2017 | Sugiyama et al. | |
| 9,583,235 | B2 | 2/2017 | Nonen et al. | |
| 9,660,318 | B2 | 5/2017 | Sugiyama et al. | |
| 2003/0150633 | A1 * | 8/2003 | Hirakawa | H01B 11/002 174/36 |
| 2006/0254801 | A1 | 11/2006 | Stevens | |
| 2010/0307790 | A1 | 12/2010 | Okano | |
| 2011/0100682 | A1 * | 5/2011 | Nonen | H01B 11/203 174/254 |
| 2011/0127062 | A1 | 6/2011 | Cases et al. | |
| 2012/0024566 | A1 | 2/2012 | Shimosawa et al. | |
| 2012/0080211 | A1 | 4/2012 | Brown et al. | |
| 2012/0152589 | A1 | 6/2012 | Kumakura et al. | |
| 2012/0227998 | A1 * | 9/2012 | Lindstrom | H01B 11/1025 174/103 |
| 2013/0175081 | A1 * | 7/2013 | Watanabe | H01B 11/1834 174/363 |
| 2013/0333913 | A1 * | 12/2013 | Nonen | H01B 11/085 174/34 |
| 2014/0048302 | A1 * | 2/2014 | Nonen | H01B 11/02 174/34 |
| 2014/0102783 | A1 | 4/2014 | Nagahashi et al. | |
| 2014/0305676 | A1 | 10/2014 | Sugiyama et al. | |
| 2015/0000954 | A1 * | 1/2015 | Nonen | H01B 11/20 174/103 |
| 2015/0255928 | A1 | 9/2015 | Liptak et al. | |
| 2016/0111187 | A1 | 4/2016 | Kodama | |
| 2016/0155540 | A1 | 6/2016 | Matsuda et al. | |
| 2016/0300642 | A1 * | 10/2016 | Kodama | H01B 3/307 |
| 2016/0343474 | A1 | 11/2016 | Nichols | |
| 2016/0372235 | A1 | 12/2016 | Sugiyama et al. | |
| 2017/0103830 | A1 | 4/2017 | Defter et al. | |
| 2018/0096755 | A1 | 4/2018 | Tsujino et al. | |

FOREIGN PATENT DOCUMENTS

| | | |
|---|---|---|
| CN | 102231303 | 11/2011 |
| CN | 203931605 | 11/2014 |
| CN | 105741965 | 7/2016 |
| JP | 2000040423 | 2/2000 |
| JP | 2001093357 | 4/2001 |
| JP | 2012009321 | 1/2012 |
| JP | 2012238468 | 12/2012 |
| JP | 2013038082 | 2/2013 |
| JP | 2013258009 | 12/2013 |
| JP | 2014038802 | 2/2014 |
| JP | 2014078339 | 5/2014 |
| JP | 2014099404 | 5/2014 |
| JP | 2014142247 | 8/2014 |
| JP | 2014154490 | 8/2014 |
| JP | 2014157709 | 8/2014 |
| JP | 2015076138 | 4/2015 |
| JP | 2015146298 | 8/2015 |
| JP | 2015204195 | 11/2015 |
| JP | 2015230836 | 12/2015 |
| JP | 2016015255 | 1/2016 |
| JP | 2016027547 | 2/2016 |
| JP | 2016072007 | 5/2016 |
| JP | 2016072196 | 5/2016 |
| JP | 2016110960 | 6/2016 |
| JP | 2016213111 | 12/2016 |
| WO | 96041351 | 12/1996 |

OTHER PUBLICATIONS

Co-pending U.S. Appl. No. 15/969,264, filed May 2, 2018.
Co-pending U.S. Appl. No. 15/952,690, filed Apr. 13, 2018.
Co-pending U.S. Appl. No. 16/159,003, filed Oct. 12, 2018.
Co-pending U.S. Appl. No. 16/159,053, filed Oct. 12, 2018.

* cited by examiner

ELECTRICAL CABLE

BACKGROUND OF THE INVENTION

The subject matter herein relates generally to electrical cables that provide shielding around signal conductors.

Shielded electrical cables are used in high-speed data transmission applications in which electromagnetic interference (EMI) and/or radio frequency interference (RFI) are concerns. Electrical signals routed through shielded cables may radiate less EMI/RFI emissions to the external environment than electrical signals routed through non-shielded cables. In addition, the electrical signals being transmitted through the shielded cables may be better protected against interference from environmental sources of EMI/RFI than signals through non-shielded cables.

Shielded electrical cables are typically provided with a cable shield formed by a tape wrapped around the conductor assembly. Signal conductors are typically arranged in pairs conveying differential signals. The signal conductors are surrounded by an insulator and the cable shield is wrapped around the insulator. However, where the cable shield overlaps itself, a void is created that is filled with air, which has a different dielectric constant than the material of the insulator and shifts the cable shield farther from the signal conductor. The void affects the electrical performance of the conductors in the electrical cable by changing the dielectric constant of the material near one of the conductors compared to the other of the conductors within the differential pair, leading the electrical skew.

A need remains for an electrical cable that improves signal performance.

BRIEF DESCRIPTION OF THE INVENTION

In an embodiment, an electrical cable is provided including a conductor assembly having a first conductor, a second conductor, and an insulator structure surrounding the first conductor and the second conductor. The insulator structure has an outer surface. The first and second conductors carry differential signals. A cable shield is wrapped around the conductor assembly and engages the outer surface of the insulator structure. The cable shield has an inner edge and a flap covering the inner edge. The cable shield forms a void at the inner edge being located closer to the first conductor than the second conductor. The first conductor has a first diameter and the second conductor has a second diameter. The first diameter is less than the second diameter.

In an embodiment, an electrical cable is provided including a conductor assembly having a first conductor, a second conductor, and an insulator structure surrounding the first conductor and the second conductor. The insulator structure has an outer surface. The first and second conductors carry differential signals. A cable shield is wrapped around the conductor assembly and engages the outer surface of the insulator structure. The cable shield has an inner edge and a flap covering the inner edge. The cable shield forms a void at the inner edge being located closer to the first conductor than the second conductor. The void has a volume creating a decrease in capacitance of the first conductor compared to the second conductor. The first conductor has a first diameter and the second conductor has a second diameter. The first diameter is less than the second diameter. The diameter difference between the first diameter and the second diameter creating an increase in inductance in the first conductor compared to the second conductor. The increase in inductance is proportional to the decrease in capacitance to balance skew effects.

In an embodiment, an electrical cable is provided including a conductor assembly having a first conductor, a second conductor, and an insulator structure surrounding the first conductor and the second conductor. The first and second conductors carry differential signals. The insulator structure is a monolithic, unitary structure surrounding both the first and second conductors. The insulator structure has an outer surface being symmetrical about a bisector axis between the first and second conductors. A cable shield is wrapped around the conductor assembly and engages the outer surface of the insulator structure. The cable shield has an inner edge and a flap covering the inner edge. The cable shield forms a void at the inner edge being located closer to the first conductor than the second conductor. The first conductor has a first diameter and the second conductor has a second diameter. The first diameter is less than the second diameter.

DETAILED DESCRIPTION OF THE INVENTION

Figure 1:
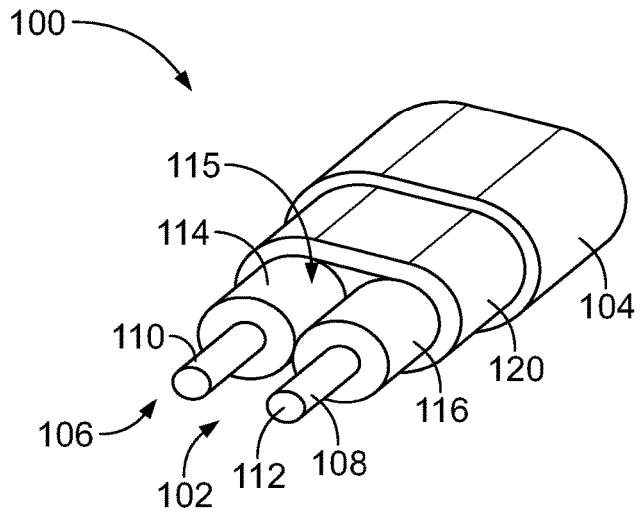
FIG. 1 is a perspective view of a portion of an electrical cable formed in accordance with an embodiment.

FIG. 1 is a perspective view of a portion of an electrical cable 100 formed in accordance with an embodiment. The electrical cable 100 may be used for high speed data transmission between two electrical devices, such as electrical switches, routers, and/or host bus adapters. For example, the electrical cable 100 may be configured to transmit data signals at speeds of at least 10 gigabits per second (Gbps), which is required by numerous signaling standards, such as the enhanced small form-factor pluggable (SFP+) standard. For example, the electrical cable 100 may be used to provide a signal path between high speed connectors that transmit data signals at high speeds.

The electrical cable 100 includes a conductor assembly 102. The conductor assembly 102 is held within an outer jacket 104 of the electrical cable 100. The outer jacket 104 surrounds the conductor assembly 102 along a length of the conductor assembly 102. In FIG. 1, the conductor assembly 102 is shown protruding from the outer jacket 104 for clarity in order to illustrate the various components of the conductor assembly 102 that would otherwise be obstructed by the outer jacket 104. It is recognized, however, that the outer jacket 104 may be stripped away from the conductor assembly 102 at a distal end 106 of the cable 100, for example, to allow for the conductor assembly 102 to terminate to an electrical connector, a printed circuit board, or the like. In an alternative embodiment, the electrical cable 100 does not include the outer jacket 104.

The conductor assembly 102 includes inner conductors arranged in a pair 108 that are configured to convey data signals. In an exemplary embodiment, the pair 108 of conductors defines a differential pair conveying differential signals. The conductor assembly 102 includes a first conductor 110 and a second conductor 112. In various embodiments, the conductor assembly 102 is a twin-axial differential pair conductor assembly. In an exemplary embodiment, the conductor assembly 102 includes an insulator structure 115 surrounding the conductors 110, 112. In various embodiments, the insulator structure 115 is a monolithic, unitary insulator (FIG. 3) surrounding both conductors 110, 112. In other various embodiments, as in the illustrated embodiment of FIG. 1, the conductor assembly 102 includes a first insulator 114 and a second insulator 116 surrounding the first and second conductors 110, 112, respectively. The first and second insulators 114, 116 are separate and discrete insulators sandwiched together within the cable core of the electrical cable 100. The first and second insulators 112, 114 thus define a multi-piece insulator structure 115. The conductor assembly 102 includes a cable shield 120 surrounding the insulators 114, 116 and providing electrical shielding for the conductors 110, 112.

The conductors 110, 112 extend longitudinally along the length of the cable 100. The conductors 110, 112 are formed of a conductive material, for example a metal material, such as copper, aluminum, silver, or the like. Each conductor 110, 112 may be a solid conductor or alternatively may be composed of a combination of multiple strands wound together. The conductors 110, 112 extend generally parallel to one another along the length of the electrical cable 100.

The first and second insulators 114, 116 surround and engage outer perimeters of the corresponding first and second conductors 110, 112. As used herein, two components "engage" or are in "engagement" when there is direct physical contact between the two components. The insulators 114, 116 are formed of a dielectric material, for example one or more plastic materials, such as polyethylene, polypropylene, polytetrafluoroethylene, or the like. The insulators 114, 116 may be formed directly to the inner conductors 110, 112 by a molding process, such as extrusion, overmolding, injection molding, or the like. The insulators 114, 116 extend between the conductors 110, 112 and the cable shield 120. The insulators 114, 116 separate or space apart the conductors 110, 112 from one another and separate or space apart the conductors 110, 112 from the cable shield 120. The insulators 114, 116 maintain separation and positioning of the conductors 110, 112 along the length of the electrical cable 100. The size and/or shape of the conductors 110, 112, the size and/or shape of the insulators 114, 116, and the relative positions of the conductors 110, 112 and the insulators 114, 116 may be modified or selected in order to attain a particular impedance for the electrical cable 100. In an exemplary embodiment, the conductors 110, 112 and/or the insulators 114, 116 may be asymmetrical to compensate for skew imbalance induced by the cable shield 120 on either or both of the conductors 110, 112. For example, in an exemplary embodiment, the first conductor 110 has a smaller diameter than the second conductor 112 to increase inductance in the first conductor, which compensates for the decrease in capacitance in the first conductor 110 due to the void near the first conductor formed by wrapping the longitudinal cable shield 120 around the cable core.

The cable shield 120 engages and surrounds outer perimeters of the insulators 114, 116. In an exemplary embodiment, the cable shield 120 is wrapped around the insulators 114, 116. For example, in an exemplary embodiment, the cable shield 120 is formed as a longitudinal wrap, otherwise known as a cigarette wrap, where the seam of the wrap extends longitudinally along the electrical cable 100. The seam, and thus the void created by the seam, is in the same location along the length of the electrical cable 100. The cable shield 120 is formed, at least in part, of a conductive material. In an exemplary embodiment, the cable shield 120 is a tape configured to be wrapped around the cable core. For example, the cable shield 120 may include a multi-layer tape having a conductive layer and an insulating layer, such as a backing layer. The conductive layer and the backing layer may be secured together by adhesive. An adhesive layer may be provided along the interior of the cable shield 120 to secure the cable shield 120 to the insulator structure 115 and/or itself. The conductive layer may be a conductive foil or another type of conductive layer. The insulating layer may be a polyethylene terephthalate (PET) film, or similar type of film. The conductive layer provides both an impedance reference layer and electrical shielding for the first and second conductors 110, 112 from external sources of EMI/RFI interference and/or to block cross-talk between other conductor assemblies 102 or electrical cables 100. In an exemplary embodiment, the electrical cable 100 includes a wrap (not shown) or another layer around the cable shield 120 that holds the cable shield 120 on the insulators 114, 116. For example, the electrical cable 100 may include a helical wrap. The wrap may be a heat shrink wrap. The wrap is located inside the outer jacket 104.

The outer jacket 104 surrounds and engages the outer perimeter of the cable shield 120. In the illustrated embodiment, the outer jacket 104 engages the cable shield 120 along substantially the entire periphery of the cable shield 120. The outer jacket 104 is formed of at least one dielectric material, such as one or more plastics (for example, vinyl, polyvinyl chloride (PVC), acrylonitrile butadiene styrene (ABS), or the like). The outer jacket 104 is non-conductive, and is used to insulate the cable shield 120 from objects outside of the electrical cable 100. The outer jacket 104 also protects the cable shield 120 and the other internal components of the electrical cable 100 from mechanical forces, contaminants, and elements (such as fluctuating temperature and humidity). Optionally, the outer jacket 104 may be extruded or otherwise molded around the cable shield 120. Alternatively, the outer jacket 104 may be wrapped around the cable shield 120 or heat shrunk around the cable shield 120.

Figure 2:
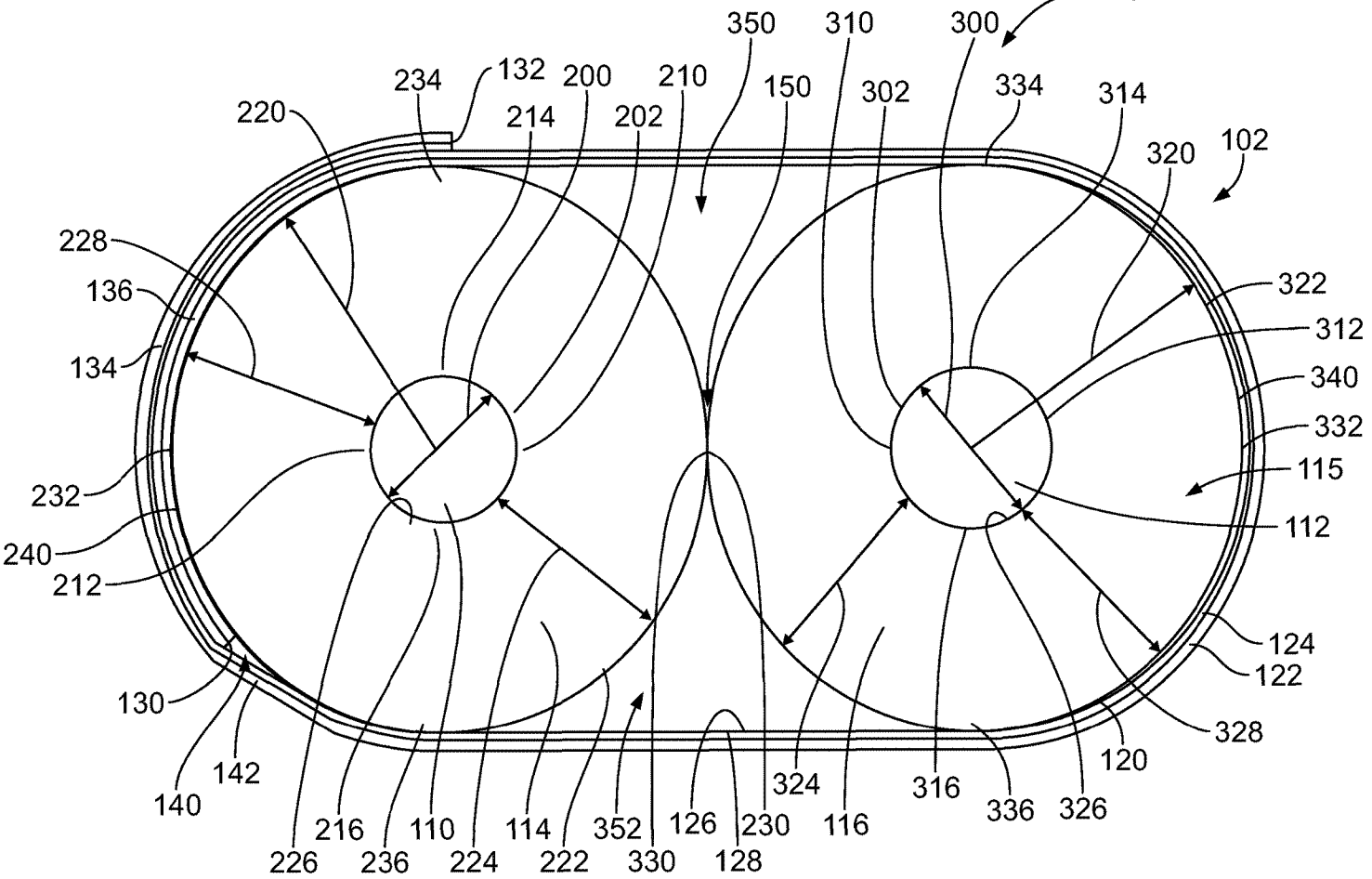
FIG. 2 is a cross-sectional view of the conductor assembly in accordance with an exemplary embodiment.

FIG. 2 is a cross-sectional view of the conductor assembly 102 in accordance with an exemplary embodiment. The cable shield 120 is wrapped around the first and second insulators 114, 116 in the cable core. The cable shield 120 includes a conductive layer 122 and an insulating layer 124. In the illustrated embodiment, the insulating layer 124 is provided on an interior 126 of the cable shield 120 and the conductive layer 122 is provided on an exterior 128 of the cable shield 120; however, the conductive layer 122 may be provided on the interior of the cable shield in alternative embodiments.

The cable shield 120 includes an inner edge 130 and an outer edge 132. When the cable shield 120 is wrapped around the cable core, a flap 134 of the cable shield 120 overlaps the inner edge 130 and a segment 136 of the cable shield 120 on a seam side of the electrical cable 100. The overlapping portion of the cable shield 120 forms a seam along the seam side of the electrical cable 100. The interior 126 of the flap 134 may be secured to the exterior 128 of the segment 136 at the seam, such as using adhesive. The interior 126 of portions of the cable shield 120 may be secured directly to the first and second insulators 114, 116, such as using adhesive. In addition, or in lieu of adhesive, the cable shield 120 may be held in place around the cable core by an additional helical wrap, such as a heat shrink wrap. When the cable shield 120 is wrapped over itself to form the flap 134, a void 140 is created at the seam side of the electrical cable 100. In various embodiments, the void 140 is a pocket of air defined between the interior 126 of an elevated segment 142 of the cable shield 120 and one of the insulators, such as the first insulator 114. In other various embodiments, the void 140 may be filled with another material, such as adhesive or other dielectric material. The elevated segment 142 is elevated or lifted off of the first insulator 114 to allow the flap 134 to clear the inner edge 130. The elevated segment moves the cable shield farther from the first conductor 110, which affects the inductance and capacitance of the first conductor 110. The volume of the air in the void 140 affects the electrical characteristics of the nearest conductor, such as the first conductor 110, by changing the effective dielectric constant of the dielectric material between the first conductor 110 and the conductive layer 122 of the cable shield 120. The air in the void 140 and/or moving the elevated segment 142 farther from the first conductor 110 decreases the capacitance to ground of the first conductor 110, which speeds up the signals in the first conductor 110, leading to a skew imbalance for the electrical cable 100 compared to the second conductor 112. While it may be desirable to reduce the volume of the void 140, the presence of the void 140 is inevitable when the electrical cable 100 is assembled due to the flap 134 overlapping the segment 136. The air in the void 140 leads to a skew imbalance for the first conductor 110 by changing the effective dielectric constant of the dielectric material around the first conductor 110, compared to the second conductor 112. For example, signals transmitted by the first conductor 110 may be transmitted faster than the signals transmitted by the second conductor 112, leading to skew in the differential pair. Signal delay in the conductor is a function of inductance and capacitance of the conductor. Delay is the square root of inductance times capacitance. The speed of the signal in the conductor is the inverse of the delay, and is thus also a function of inductance and capacitance. Decrease in capacitance of the first conductor 110, due to the void 140, is compensated with a proportional increase in inductance in the first conductor 110 to keep the delay similar to the signal in the second conductor 112 and thus mitigate skew imbalance. In an exemplary embodiment, the inductance of the first conductor 110 is increased by decreasing the diameter of the first conductor 110 compared to the second conductor 112. Capacitance of the first conductor 110 is lowered by the void 140 due to its change on the effective dielectric constant. Capacitance of the first conductor 110 is lowered because the cable shield 120 along the void 140 (for example, the flap 134, is shifted farther away from the first conductor 110 along the void 140.

In FIG. 2, the conductor assembly 102 is provided with the first and second insulators 114, 116 of the insulator structure 115 being separate insulators engaging and fully surrounding the first and second conductors 110, 112, respectively. The first insulator 114 may be molded, extruded or otherwise formed with the first conductor 110 and the second insulator 116 may be molded, extruded or otherwise formed with the second conductor 112 separately from the first insulator 114 and the first conductor 110. The first and second insulators 114, 116 engage one another along a seam 150 that is located between the conductors 110, 112. In an example, the conductor assembly 102 shown in FIG. 2 may be formed by initially applying the first and second insulators 114, 116 to the respective first and second conductors 110, 112, independently, to form two insulated wires. The insulators 114, 116 of the two insulated wires are then pressed into contact with one another, and optionally bonded to one another, at the seam 150, and subsequently collectively surrounded by the cable shield 120. In an exemplary embodiment, the outer perimeters of the insulators 114, 116 are identical. For example, the first and second insulators 114, 116 have equal diameters. However, in alternative embodiments, the insulators may be asymmetrical, such as having different diameters. The outer perimeters of the insulators 114, 116 may have a generally lemniscate or figure-eight shape, due to the combination of the two circular or elliptical insulators 114, 116.

In an exemplary embodiment, the first conductor 110 has a first conductor outer surface 202 having a circular cross-section having a first diameter 200. The first conductor 110 has an inner end 210 facing the second conductor 112 and an outer end 212 opposite the inner end 210. The first conductor 110 has a first side 214 (for example, a top side) and a second side 216 (for example, a bottom side) opposite the first side 214. The first and second sides 214, 216 are equidistant from the inner and outer ends 210, 212.

In an exemplary embodiment, the first insulator 114 has a circular cross-section surrounding the first conductor 110. The first insulator 114 has a first radius 220 to a first insulator outer surface 222. The first insulator 114 has a first thickness 224 between a first insulator inner surface 226 and the first insulator outer surface 222. The first thickness 224 defines a first distance or shield distance 228 between the first conductor 110 and the cable shield 120. The first insulator inner surface 226 engages the first conductor outer surface 202. The first insulator outer surface 222 engages the second insulator 116 at the seam 150. The first insulator 114 has an inner end 230 facing the second insulator 116 and an outer end 232 opposite the inner end 230. The first insulator 114 has a first side 234 (for example, a top side) and a second side 236 (for example, a bottom side) opposite the first side 234. The first and second sides 234, 236 are equidistant from the inner and outer ends 230, 232.

The cable shield 120 engages the first insulator outer surface 222 along a first segment 240. For example, the first segment 240 may extend from approximately the first side 234 to approximately the second side 236 while passing the outer end 232. The first segment 240 may encompass approximately half of the outer circumference of the first insulator outer surface 222. The shield distance 228 between the cable shield 120 and the first conductor 110 is defined by the thickness 224 of the first insulator 114 between the inner surface 226 and the outer surface 222. The shield distance 228 affects the electrical characteristics of the signals transmitted by the first conductor 110. For example, the shield distance 228 affects the inductance and the capacitance of the first conductor 110, which affects the delay or skew of the signal, the insertion loss of the signal, the return loss of the signal, and the like.

In the illustrated embodiment, the void 140 is positioned along the first segment 240, such as for a section between the second side 236 and the outer end 232. The elevated segment 142 is thus defined along the first segment 240. The cable shield 120 engages the first insulator outer surface 222 on both sides of the elevated segment 240. The flap 134 wraps around a portion of the first insulator 114, such as from the elevated segment 142 to the outer edge 132. Optionally, the outer edge 132 may be located along the first segment 140, such as approximately aligned with the first side 234. The flap 134 provides electrical shielding at the inner edge 130.

The void 140 affects the electrical characteristics of the signals transmitted by the first conductor 110. For example, the void 140 decreases capacitance of the first conductor by introducing air in the shield space, which has a lower dielectric constant than the dielectric material of the first insulator 114. The decrease in capacitance affects the delay, and thus the speed of the signals transmitted by the first conductor, which has a skew effect on the signals transmitted by the first conductor 110, relative to the signals transmitted by the second conductor 112. For example, the skew may be affected by having the signals travel faster in the first conductor 110 compared to a hypothetical situation in which no void 140 were present. Thus, the void 140 leads to skew problems in the conductor assembly 102.

In an exemplary embodiment, the first conductor 110 is modified compared to the second conductor 112 to balance or correct for the skew imbalance, such as to improve the skew imbalance. The first conductor 110 is modified to allow for a zero skew or near-zero skew in the conductor assembly 102. In various embodiments, the diameter 200 of the first conductor 110 is decreased compared to the second conductor 112 to create a proportional increase in the inductance in the first conductor 110 to compensate for the decrease in capacitance and keep the delay similar to the second conductor 112 and eliminate skew. The decrease in the diameter 200 of the first conductor 110 is used to balance the delay per unit length compared to the second conductor 112. The first diameter 200 is selected to balance skew effects of the void 140 on the first conductor 110 compared to the second conductor 112 along the length of the electrical cable 100. Even though the first and second sides have different capacitances, due to the void 140 only being present on the first side and absent on the second side, the first and second sides have different inductances, due to the different diameters of the first and second conductors 110, 112, leading to a balanced speed of the signals in the first and second conductors 110, 112 to have a zero or near-zero skew imbalance along the length of the electrical cable 100.

In an exemplary embodiment, the second conductor 112 has a second conductor outer surface 302 having a circular cross-section having a second diameter 300. In an exemplary embodiment, the second diameter 300 is larger than the first diameter 200 of the first conductor 110. The second conductor 112 has an inner end 310 facing the inner end 210 of the first conductor 110 and an outer end 312 opposite the inner end 310. The second conductor 112 has a first side 314 (for example, a top side) and a second side 316 (for example, a bottom side) opposite the first side 314. The first and second sides 314, 316 are equidistant from the inner and outer ends 310, 312.

In an exemplary embodiment, the second insulator 116 has a circular cross-section surrounding the second conductor 112. The second insulator 116 has a second radius 320 to a second insulator outer surface 322. In an exemplary embodiment, the second radius 320 is equal to the first radius 220. The second insulator 116 has a second thickness 324 between a second insulator inner surface 326 and the second insulator outer surface 322. The thickness 324 defines a second distance or shield distance 328 between the second conductor 112 and the cable shield 120. The second insulator inner surface 326 engages the second conductor outer surface 302. The second insulator outer surface 322 engages the first insulator 114 at the seam 150. The second insulator 116 has an inner end 330 facing the second insulator 116 and an outer end 332 opposite the inner end 330. The second insulator 116 has a first side 334 (for example, a top side) and a second side 336 (for example, a bottom side) opposite the first side 334. The first and second sides 334, 336 are equidistant from the inner and outer ends 330, 332.

The cable shield 120 engages the second insulator outer surface 322 along a second segment 340. For example, the second segment 340 may extend from approximately the first side 334 to approximately the second side 336 while passing the outer end 332. The second segment 340 may encompass approximately half of the outer circumference of the second insulator outer surface 322. In an exemplary embodiment, the first and second insulators 114, 116 are lemniscate and thus define a first pocket 350 and a second pocket 352 within the cable core inside of the interior 126 of the cable shield 120. In an exemplary embodiment, the first and second pockets 350, 352 are generally symmetrical, and thus do not have an appreciable affect on skew imbalance for the first or second conductors 110, 112. The conductors are more closely coupled to the cable shield along the first and second segments 240, 340, respectively. Thus, the portion of the cable shield 120 beyond the first and second insulator outer surfaces 222, 322 across the pockets 350, 352 does not affect skew, but rather the interaction between the conductors 110, 112 and the cable shield 120 along the first and second segments 240, 340 control the skew performance.

The shield distance 328 between the cable shield 120 and the second conductor 112 is defined by the thickness 324 of the second insulator 116 between the inner surface 326 and the outer surface 322. The shield distance 328 affects the electrical characteristics of the signals transmitted by the second conductor 112. For example, the shield distance 328 affects the inductance and the capacitance of the second conductor 112, which affects the delay or skew of the signal, the insertion loss of the signal, the return loss of the signal, and the like.

In the illustrated embodiment, the second segment 340 does not include any void like the void 140. The second conductor 112 is thus not subjected to the same delay change as the first conductor 110 from the void 140. When comparing the first and second conductors 110, 112, the void 140 creates a skew imbalance between the first and second conductors 110, 112 by decreasing capacitance of the first conductor 110 as compared to the second conductor 112, which affects the velocity or speed of the signal transmission through the first conductor 110 as compared to the second conductor 112. However, the first conductor 110 has a smaller diameter 200 than the second conductor 112, which increases inductance of the first conductor 110 as compared to the second conductor 112, which affects the velocity or speed of the signal transmission through the first conductor 110 as compared to the second conductor 112. In an exemplary embodiment, for the first conductor 110, the decrease in capacitance is compensated for by a proportional increase in inductance, thus keeping the delay (square root of inductance times capacitance) similar or the same leading to zero or near-zero skew. The asymmetrically designed conductors 110, 112 (for example, smaller diameter first conductor 110 and larger diameter second conductor 112) compensates for the void 140. In an exemplary embodiment, the first diameter 200 is selected based on the size of the void 140 and the volume of air introduced along the first conductor 110 compared to the second conductor 112 along the length of the electrical cable 100. For example, the shape and shape of the void 140 controls the volume of air introduced in the shield area, and thus the amount of decrease in capacitance. The thickness of the cable shield 120 at the inner edge 130 affects the size and shape of the void 140, such as by affecting the height and the width of the void 140. In the illustrated embodiment, the void 140 is generally triangular shaped having a maximum height at the inner edge 130 and tapering down toward zero height at the lift off point of the elevated segment 142. The volume of the void 140 creates a decrease in capacitance of the first conductor 110 compared to the second conductor 112 and the diameter difference between the first diameter 200 and the second diameter 300 creates an increase in inductance in the first conductor 110 compared to the second conductor 112. The increase in inductance is proportional to the decrease in capacitance to balance skew effects. In an exemplary embodiment, the increase in inductance is equal to the decrease in capacitance leading to skew balance. In an exemplary embodiment, the void 140 creates a first skew imbalance and reducing the diameter 200 of the first conductor 110 compared to the diameter 300 of the second conductor 112 creates a second skew imbalance opposing the first skew imbalance, such as to create a zero skew or a near-zero skew situation.

Figure 3:
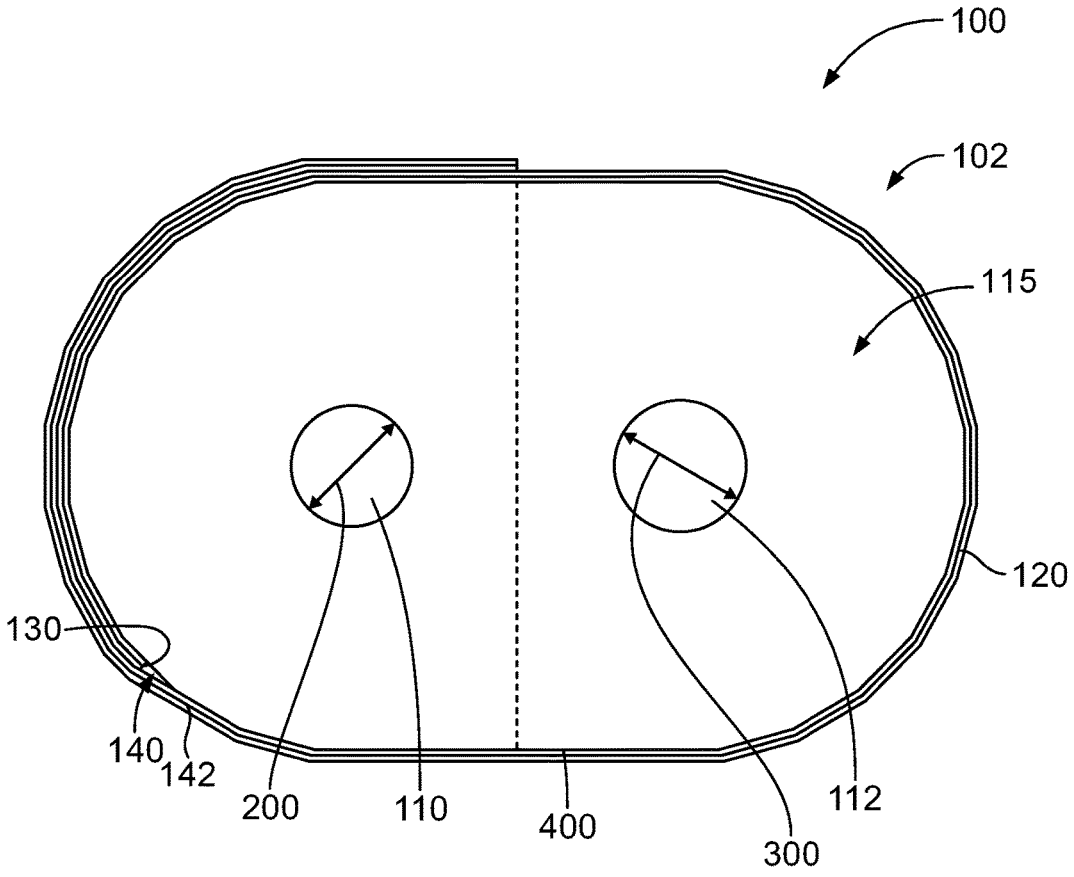
FIG. 3 is a cross-sectional view of the conductor assembly according to another exemplary embodiment.

FIG. 3 is a cross-sectional view of the conductor assembly 102 according to another exemplary embodiment. In the alternative embodiment shown in FIG. 3, the insulator structure 115 is one integral member that surrounds and extends between the first and second conductors 110, 112. For example, the conductor assembly 102 may be formed by molding, extruding or otherwise applying the material of the insulator structure 115 to the first and second conductors 110, 112 at the same time. The conductor assembly 102 forms a twin-axial insulated wire, and the cable shield 120 is subsequently applied around the twin-axial insulated wire. In FIG. 3, the outer perimeter of the insulator structure 115 may have a generally elliptical or oval shape. It is recognized that the insulator structure 115 need not have the elliptical shape in other embodiments.

The cable shield 120 generally conforms to the insulator structure 115, except at the void 140. In an embodiment, the cross-sectional shape of the cable shield 120 is geometrically similar to the cross-sectional shape of the outer perimeter of the insulator structure 115. The term "geometrically similar" is used to mean that two objects have the same shape, although different sizes, such that one object is a scaled relative to the other object. As shown in FIG. 3, the outer perimeter of the cable shield 120 has an elliptical or oval shape along the cross-section, which is similar to the outer perimeter of the insulator structure 115.

The insulator structure 115 has an outer surface 400. The cable shield 120 is applied to the outer surface 400. The shape of the insulator structure 115 may be generally symmetrical about a bisector axis between the first and second conductors 110, 112. The first conductor 110 has the first diameter 200 and the second conductor 112 has the second diameter 300. The first diameter 200 is smaller than the second diameter 300 to compensate for the air gap 140 and balance skew effects of the void 140 on the first conductor 110 compared to the second conductor 112 along the length of the electrical cable 100. The diameter 200 of the first conductor 110 is decreased compared to the second conductor 112 to create a proportional increase in the inductance in the first conductor 110 to compensate for the decrease in capacitance and keep the delay similar to the second conductor 112 and eliminate skew. The decrease in the diameter 200 of the first conductor 110 is used to balance the skew compared to the second conductor 112. Even though the first and second sides have different capacitances, due to the void 140 only be present on the first side and absent on the second side, the first and second sides have different inductances, due to the different diameters of the first and second conductors 110, 112, leading to a balanced speed of the signals in the first and second conductors 110, 112 to have a zero or near-zero skew imbalance along the length of the electrical cable 100.

In an exemplary embodiment, for the first conductor 110, the decrease in capacitance is compensated for by a proportional increase in inductance, thus keeping the delay (square root of inductance times capacitance) similar or the same leading to zero or near-zero skew. The asymmetrically designed conductors 110, 112 (for example, smaller diameter first conductor 110 and larger diameter second conductor 112) compensates for the void 140. In an exemplary embodiment, the first diameter 200 is selected based on the size of the void 140 and the volume of air introduced along the first conductor 110 compared to the second conductor 112 along the length of the electrical cable 100. For example, the shape and shape of the void 140 controls the volume of air introduced in the shield area, and thus the amount of decrease in capacitance. The thickness of the cable shield 120 at the inner edge 130 affects the size and shape of the void 140, such as by affecting the height and the width of the void 140. In the illustrated embodiment, the void 140 is generally triangular shaped having a maximum height at the inner edge 130 and tapering down toward zero height at the lift off point of the elevated segment 142. In an exemplary embodiment, the void 140 creates a first skew imbalance and reducing the diameter 200 of the first conductor 110 compared to the diameter 300 of the second conductor 112 creates a second skew imbalance opposing the first skew imbalance, such as to create a zero skew or a near-zero skew situation.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical cable comprising:

a conductor assembly having a first conductor, a second conductor, and an insulator structure surrounding the first conductor and the second conductor, the insulator structure having an outer surface, the first and second conductors carrying differential signals; and a cable shield wrapped around the conductor assembly and engaging the outer surface of the insulator structure, the cable shield having an inner edge and a flap covering the inner edge, the cable shield forming a void at the inner edge, the void being located closer to the first conductor than the second conductor;

wherein the first conductor has a first diameter and the second conductor has a second diameter, the first diameter being less than the second diameter.

2. The electrical cable of claim 1, wherein the first diameter is selected to balance skew effects of the void on the first conductor compared to the second conductor along the length of the electrical cable.

3. The electrical cable of claim 1, wherein the void has a volume creating a decrease in capacitance of the first conductor compared to the second conductor, the diameter difference between the first diameter and the second diameter creating an increase in inductance in the first conductor compared to the second conductor, wherein the increase in inductance is proportional to the decrease in capacitance to balance skew effects.

4. The electrical cable of claim 3, wherein the increase in inductance is equal to the decrease in capacitance leading to skew balance.

5. The electrical cable of claim 1, wherein the insulator structure is a monolithic, unitary structure surrounding both the first and second conductors.

6. The electrical cable of claim 1, wherein the insulator structure includes a first insulator surrounding the first conductor and a second insulator surrounding the second conductor, the first and second insulators being separate and discrete from each other and abutting each other in the electrical cable at a seam.

7. The electrical cable of claim 6, wherein the first insulator and the second insulator have equal radiuses.

8. The electrical cable of claim 1, wherein the first and second conductors are asymmetrical relative to the cable shield.

9. The electrical cable of claim 1, wherein the void creates a first skew imbalance and selecting the first diameter less than the second diameter creates a second skew imbalance opposing the first skew imbalance.

10. An electrical cable comprising:

a conductor assembly having a first conductor, a second conductor, and an insulator structure surrounding the first conductor and the second conductor, the insulator structure having an outer surface, the first and second conductors carrying differential signals; and a cable shield wrapped around the conductor assembly and engaging the outer surface of the insulator structure, the cable shield having an inner edge and a flap covering the inner edge, the cable shield forming a void at the inner edge, the void being located closer to the first conductor than the second conductor, the void having a volume creating a decrease in capacitance of the first conductor compared to the second conductor;

wherein the first conductor has a first diameter and the second conductor has a second diameter, the first diameter being less than the second diameter, the diameter difference between the first diameter and the second diameter creating an increase in inductance in the first conductor compared to the second conductor, wherein the increase in inductance is proportional to the decrease in capacitance to balance skew effects.

11. The electrical cable of claim 10, wherein d the first diameter is selected to balance skew effects of the void on the first conductor compared to the second conductor along the length of the electrical cable.

12. The electrical cable of claim 10, wherein the increase in inductance is equal to the decrease in capacitance leading to skew balance.

13. The electrical cable of claim 10, wherein the first and second conductors are asymmetrical relative to the cable shield.

14. The electrical cable of claim 10, wherein the void creates a first skew imbalance and selecting the first diameter less than the second diameter creates a second skew imbalance opposing the first skew imbalance.

15. An electrical cable comprising:

a conductor assembly having a first conductor, a second conductor, and an insulator structure surrounding the first conductor and the second conductor, the first and second conductors carrying differential signals, the insulator structure being a monolithic, unitary structure surrounding both the first and second conductors, the insulator structure having an outer surface, the outer surface being symmetrical about a bisector axis between the first and second conductors; and a cable shield wrapped around the conductor assembly and engaging the outer surface of the insulator structure, the cable shield having an inner edge and a flap covering the inner edge, the cable shield forming a void at the inner edge, the void being located closer to the first conductor than the second conductor;

wherein the first conductor has a first diameter and the second conductor has a second diameter, the first diameter being less than the second diameter.

16. The electrical cable of claim 15, wherein d the first diameter is selected to balance skew effects of the void on the first conductor compared to the second conductor along the length of the electrical cable.

17. The electrical cable of claim 15, wherein the void has a volume creating a decrease in capacitance of the first conductor compared to the second conductor, the diameter difference between the first diameter and the second diameter creating an increase in inductance in the first conductor compared to the second conductor, wherein the increase in inductance is proportional to the decrease in capacitance to balance skew effects.

18. The electrical cable of claim 17, wherein the increase in inductance is equal to the decrease in capacitance leading to skew balance.

19. The electrical cable of claim 15, wherein the first and second conductors are asymmetrical relative to the cable shield.

20. The electrical cable of claim 15, wherein the void creates a first skew imbalance and selecting the first diameter less than the second diameter creates a second skew imbalance opposing the first skew imbalance.

* * * * *